US005900837A

United States Patent [19]

Petrosian

[11] Patent Number: 5,900,837

[45] Date of Patent: May 4, 1999

[54] METHOD AND APPARATUS FOR COMPENSATION OF DIFFRACTION DIVERGENCE OF BEAM OF AN ANTENNA SYSTEM

[75] Inventor: Frederick N. Petrosian, Naples, Fla.

[73] Assignee: Fourth Dimension Systems Corp., Naples, Fla.

[21] Appl. No.: 08/915,702

[22] Filed: Aug. 21, 1997

[51] Int. Cl.[6] ..... H01Q 3/22

[52] U.S. Cl. ..... 342/368

[58] Field of Search ..... 342/368, 367, 342/375, 59

[56] References Cited

U.S. PATENT DOCUMENTS

| | | | |
|---|---|---|---|
| 4,032,922 | 6/1977 | Provencher | 343/854 |
| 4,060,850 | 11/1977 | Speiser . | |
| 4,216,475 | 8/1980 | Johnson | 343/100 SA |
| 4,254,417 | 3/1981 | Speiser | 343/100 SA |
| 4,270,223 | 5/1981 | Marston | 455/305 |
| 4,321,550 | 3/1982 | Evtuhov | 330/4.3 |
| 4,342,949 | 8/1982 | Harte et al. | 315/409 |
| 4,595,994 | 6/1986 | Verber et al. | 364/841 |
| 4,641,259 | 2/1987 | Shan et al. | 364/724 |
| 4,646,099 | 2/1987 | Apostolos | 342/375 |
| 4,656,601 | 4/1987 | Merritt et al. | 364/821 |
| 4,779,984 | 10/1988 | Cook | 356/346 |
| 4,806,888 | 2/1989 | Salvage et al. | 333/138 |
| 4,959,559 | 9/1990 | Ziolkowski | 307/425 |
| 5,063,385 | 11/1991 | Caschera | 342/13 |
| 5,316,003 | 5/1994 | Stouffer | 128/662.03 |
| 5,552,705 | 9/1996 | Keller | 324/239 |
| 5,675,550 | 10/1997 | Ekhaus | 367/7 |
| B1 4,959,559 | 2/1993 | Ziolkowski | 307/425 |

FOREIGN PATENT DOCUMENTS

| | | | |
|---|---|---|---|
| 458780 | 1/1975 | U.S.S.R. | G01R 27/16 |
| 1270742 A1 | 11/1986 | U.S.S.R. | G04F 10/06 |
| 1370619 A1 | 10/1987 | U.S.S.R. | G01R 29/10 |
| 1679417 A1 | 3/1991 | U.S.S.R. | G01R 29/10 |
| 1774290 A1 | 11/1992 | U.S.S.R. | G01R 29/10 |
| WO 96/29933 | 10/1996 | WIPO | A61B 8/02 |

OTHER PUBLICATIONS

"Methods and Apparatus for the Compensation of the Diffraction of an Antenna System's Beam" (article is in the Russian language).

"Thermoacoustic Engines and Refrigerators," Swift; Physics Today; Jul. 1995; pp. 22–28.

"New Electromagnetic Directed Energy Pulses," Ziolkowski; SPIE vol. 873 Microwave and Particle Beam Sources and Propagation (1988); pp. 312–319.

(List continued on next page.)

*Primary Examiner*—Mark Hellner

*Attorney, Agent, or Firm*—Sixbey, Friedman, Leedom & Ferguson, PC; Charles M. Leedom, Jr.; Eric J. Robinson

[57] ABSTRACT

The present invention provides for a method and apparatus for compensation of diffraction of beam of an antenna system. In the preferred embodiment, the antenna system is a phased array antenna. The present invention does so by controlling the phase front. The phase front is controlled by distributing frequencies such that the value of the frequency for a given emitter is proportional to the distance of the emitter from the center of the antenna system. In one embodiment of the invention, the value of the frequency for a given emitter is linear, square or otherwise, to the distance of the emitter from the center of the antenna system. A phase front formed by the time spectrum is summed with a phase front created by diffraction divergence compensation. In one embodiment, the phase front is controlled by forming the radius of the time spectrum opposite to and with the same value as the radius of the phase front created by diffraction divergence compensation. In an additional embodiment, the radius of the phase front is controlled by forming the time spectrum opposite to and with a greater value than the radius of the phase front created by diffraction divergence compensation, such that the divergence of the wave energy is reduced. In an additional embodiment, the radius of the phase front is controlled by forming the time spectrum collinear to the radius of the phase front created by diffraction divergence compensation, such that the divergence of the wave energy is increased.

62 Claims, 5 Drawing Sheets

OTHER PUBLICATIONS

"Discretized Beam Methods for Focused Radiation from Distributed Apertures," Felsen; SPIE vol. 873 Microwave and Particle Beam Sources and Propagation (1988); pp. 320–328.

"Ultrasonic Bonded Nonwovens," Lutzow; Nonwovens Industry, v24, n10, pp. 48–51; Oct. 1993.

"New Ultrasonic Method has Promise for Meats Industry," Hill; Mar. 29, 1994; Texas A&M Agriculture News Home Page.

"Improving Light Alloy Casting with Power Ultrasound," Mason; Metallurgia v61, n7, p. 224; Jul. 199 Copyright 1994 FMJ International Publications Ltd.

"Acoustics," Mintzer; pp. 26–31; and "Ultrasonics," Frost; pp. 3785–3789; Gale Encyclopedia of Scien vol. 6; 1996.

"Design Environment for Low–Amplitude ThermoAcoustic Engines, DeltaE, Version 3.0," Ward and Swift; pp. 1–134; Los Alamos National Laboratory; LA–CC–93–8; Feb. 1996; Revision Jul. 1, 1996.

"Applications of Ultrasonics in the Water Industry," Jul. 1995; Report FR/INV 0001.

GB–123: The Ultrasonic Business: What's It All About? Where are the Opportunities, Project Analyst Business Communications, Inc.; Norwalk, CT 06855.

"Diffraction Effects in Directed Radiation Beams," Hafixi and Sprangle; vol. 8, No. 5, May 1991, J. Opt. Soc. Am A; pp. 705–717.

"The Sound of Data," Fischetti; Technology Review v96, n5; pp. 17–18; Jul. 1993; Copyright Mass. Institute of Technology Alumni Association 1993.

METHOD AND APPARATUS FOR COMPENSATION OF DIFFRACTION DIVERGENCE OF BEAM OF AN ANTENNA SYSTEM

FIELD OF THE INVENTION

The present invention relates in general to transmission of wave energy and, in particular, to the propagation of pulses of wave energy by an antenna over long distances with a compensation of the diffraction divergence.

BACKGROUND OF THE INVENTION

Diffraction is a fundamental phenomenon of the propagation of wave energy fields such as, for example, electromagnetic or ultrasonic waves. Conventional methods of propagating energy waves are based on a simple solution to Maxwell's equation and the wave equation. Spherical or planar waveforms are utilized. Beams of energy will spread or diffuse as they propagate as a result of diffraction effects.

Present arrays are based on phasing a plurality of elements, all at the same frequency, to tailor the beam using interference effects. In a conventional antenna system, such as a phased antenna array driven with a monochromatic signal, only special phasing is possible. Resulting diffraction limited signal pulse beams begin to spread and decay when reaching a given length.

In many applications, it would be highly desirable to propagate a beam of wave energy over a long distance without an appreciable drop in the intensity of the beam. Such applications include, for example, radio microwave communication in which a non-divergent microwave beam would enable use of a smaller antennae, a decrease in the power of transmission, magnification of the mid-range of transmission, a decrease in the level of noise associated with transmission, and an increase in the confidentiality of the transmission. Further examples include use in radar, which would result in an increase in the range of the radar, a decrease in the required size of the radar, and a decrease in the power consumption of the radar. Still further examples include use in extremely long-range transmissions such as, for example, transmission between earth and satellites.

The traditional method of increasing the range of wave transmissions is to increase the size and power of the transmission into a wider beam or to utilize shorter wavelength transmissions. Increasing the width of the beam increases significantly the cost and power consumption required to transmit the beam while the use of shorter wavelengths such as x-rays is not practicable. Thus, over the past several years there has been significant efforts to increase the propagation and decrease the diffraction properties of wave beams.

One such attempt to reduce the diffraction of wave beams is to attempt to generate a wave packet with a broad frequency spectrum, referred to as an "electromagnetic missile." Electromagnetic missiles attempt to utilize a suitably tailored pulse shape which has an energy decay rate essentially limited by the highest frequencies present in the pulse generator. The high-frequency end of the pulse determines the furthest distance the missile can propagate. The generation and transmission of energy by electromagnetic missiles, however, has been severely limited in practice by the practical means of launching wave packets with extremely short rise times and pulse widths.

Another attempt to reduce diffraction of wave beams has been the use of a particular, monochromatic solution to the wave equation in a so-called "Bessel" beam. In this theoretical approach, the particular solution of the wave equation is diffractionless. The theoretical Bessel beam has an infinite number of lobes and therefore has infinite energy. Under the theoretical Bessel calculations, the energy content integrated over any lobe is approximately the same as the energy content in the central lobe. In practice, the lobes of the Bessel beam diffract away sequentially starting with the outer-most lobe. The central lobe persists as long as there are off-axis lobes compensating for the energy loss of the central lobe. However, the Bessel beam is not resistant to the diffractive spreading commonly associated with wave propagation. In fact, in practice a traditional Gaussian beam profile has been shown to be equally efficient to the Bessel beam profile.

Yet another attempt to reduce diffraction has been to use a particular parabolic approximation solution to the wave equation, known as an "electromagnetic directed energy pulse train." The pulses are produced by driving each element of an array of radiating sources with a particular drive function so that the results and localized packet of energy closely approximates this solution of the wave equation. However, further examination of this solution of the wave equation has demonstrated that the theoretical calculation of an improved Raleigh range was in error. The Raleigh range calculation was valid only at the pulse center and not across the width of the waist of the pulse. Appropriate calculation demonstrates that electromagnetic directed energy pulse trains do not defeat wave diffraction.

Yet another attempt to reduce diffraction has been to use a solution to the wave equation that is confined to a finite region of space in the wave zone, termed "electromagnetic bullets." This approach defines a radiation wave packet in the wave zone that is conformed to a suitable solid angle and extends over a finite radial extent to determine the sources required to generate the wave packet. However, this approach has not resulted in a computation that can solve the problem in a practical application.

What would thus be of great benefit would be a practical way to decrease divergence of propagated waves. To be practically applicable, such solution should apply new physical principals of compensation for the diffraction characteristics of wave propagation. The present invention achieves these objectives.

SUMMARY OF THE INVENTION

The present invention provides for a method and apparatus for compensation of diffraction of beam of an antenna system. In the preferred embodiment, the antenna system is a phased array antenna. The present invention does so by controlling the phase front. The phase front is controlled by distributing frequencies such that the value of the frequency for a given emitter is proportional to the distance of the emitter from the center of the antenna system. In one embodiment of the invention, the value of the frequency for a given emitter is linear, square or otherwise, to the distance of the emitter from the center of the antenna system. A phase front formed by the time spectrum is summed with a phase front created by diffraction divergence compensation. In one embodiment, the phase front is controlled by forming the radius of the time spectrum opposite to and with the same value as the radius of the phase front created by diffraction divergence compensation. In an additional embodiment, the radius of the phase front is controlled by forming the time spectrum opposite to and with a greater value than the radius of the phase front created by diffraction divergence compensation, such that the divergence of the wave energy is reduced. In an additional embodiment, the radius of the phase front is controlled by forming the time spectrum collinear to the radius of the phase front created by diffraction divergence compensation, such that the divergence of the wave energy is increased.

DETAILED DESCRIPTION OF THE INVENTION

The method of the present invention for the formation of a beam of non-divergent radiation is based on an expansion of the interference phenomena principles of Fresnel-Kirchhoff. Under the interference phenomena of Fresnel-Kirchhoff, the degree of the divergence of a beam is determined by the dimensions of the radiating surface of a propagating antenna and the wavelength nature of the radiated energy.

The radiation of electromagnetic or ultrasonic waves by the antenna is considered non-divergent if its diameter $D_0$ is much greater than its wavelength $\lambda$, $D_0 >> \lambda$. The longitudinal section of a main beam of the antenna has the angular size $\theta_{0\ 0}$ defined by:

$$\theta_{oo} = \frac{\lambda}{D_o}$$

The dispersion of radiation by an antenna with the diameter $D_o$ much greater than the wavelength $\lambda$, $D_0 >> \lambda$, is comparable to the dispersion of an optical lens with an imaginary focal distance $D_f$.

Figure 1:
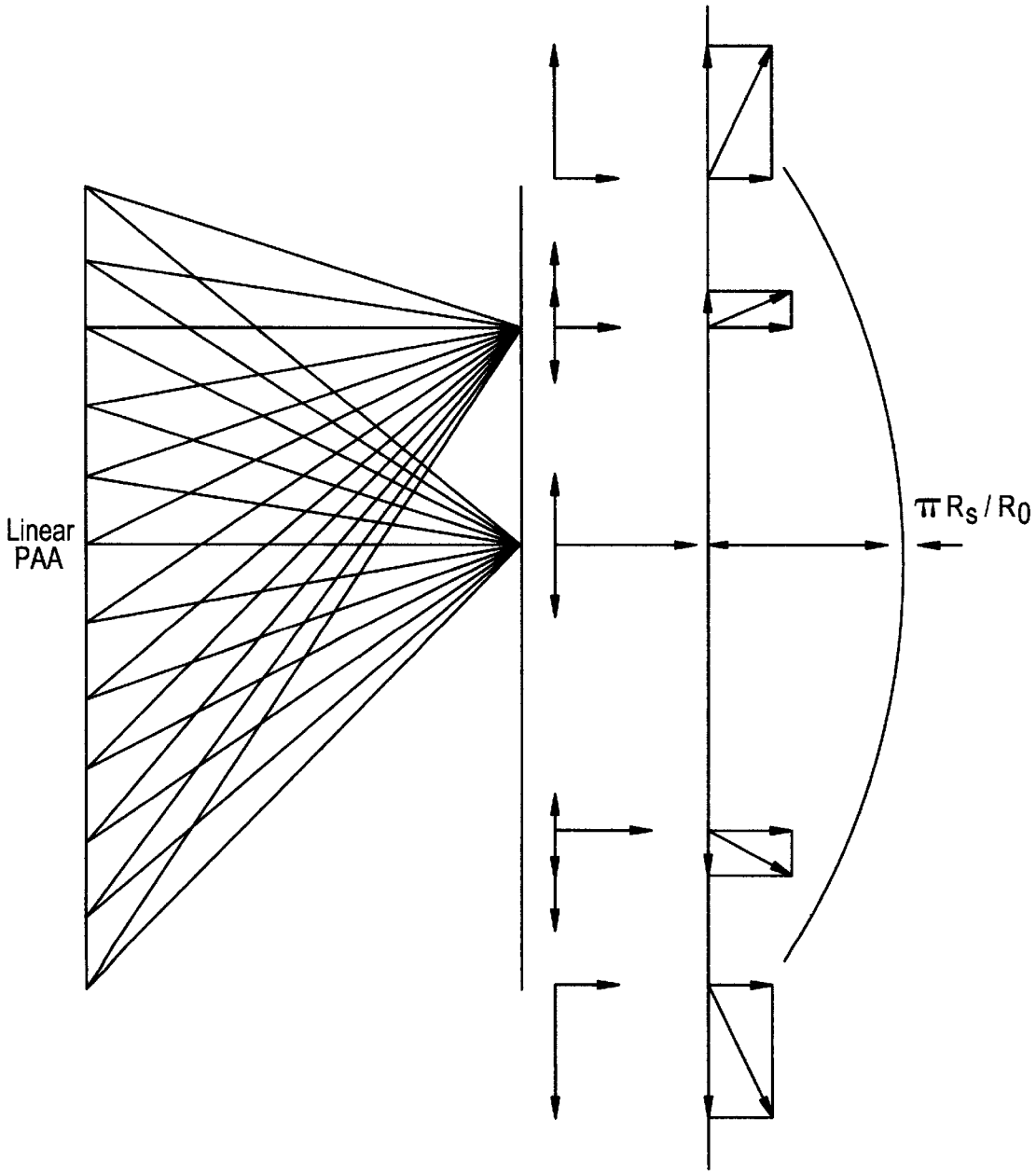
FIG. 1 is a diagram of the density of power of radiation in the main beam of an antenna.

Referring to FIG. 1, the density of a flux of power of radiation in a main beam of an antenna with a diameter $D_0 >> \lambda$ from a distance R is considered. The surface area of the antenna $S_0$ is defined by $$S_o = \pi \cdot \frac{D_o^2}{4},$$

and the radiated power $P_0$ is:

$$P_0 = S_0 \cdot \rho_0$$

where $\rho_0$ is the density of density of power in the beam. This equation is valid within a margin of error of about 20%, since about 80% of the whole emitting power is contained in a main beam of the antenna, depending on the geometry of the antenna.

Figure 2:
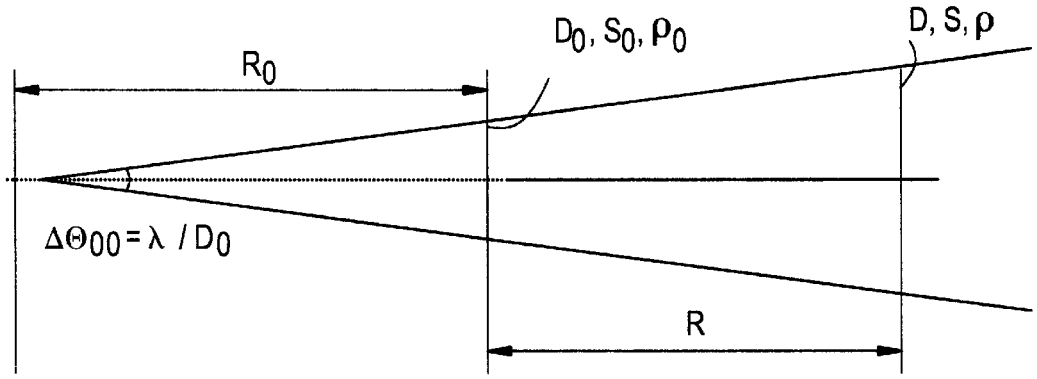
FIG. 2 is a diagram of the imaginary focal point "O" of an antenna.

Referring now to FIG. 2, at a distance $R_0$ from center of the antenna to its imaginary focal point "O", the density formula for Rayleigh distances is derived:

$$\frac{D_o}{2 \cdot R_o} = \tan\left(\frac{\Delta\theta_{oo}}{2}\right) = \frac{\lambda}{2 \cdot D_o},$$

$$\frac{D_o}{R_o} = \frac{\lambda}{D_o},$$

$$R_o = \frac{D_o^2}{\lambda}$$

where $R_0$ is the Rayleigh distance of the antenna.

From the law of conservation of energy and power, it follows that on distances R greater or equal to the Rayleigh distance $R_0 R \geqq R_0$, through any section of a beam of diameter D, the same power $P_0$ is transmitted:

$$P_0 = S_0 \cdot \rho_0 = S \cdot \rho$$

where $\rho_0$ is the density of power in the beam and S is sectional area of a beam at the distance R from the antenna.

From this relationship, the dependence of impairment of density of a power flux of radiation $\rho$ at a distance R is derived:

$$\rho = \rho_o \cdot \frac{S_o}{S} = \rho_o \cdot \frac{D_o^2}{D^2}$$

Since $$\frac{D_o}{D} = \frac{R_o}{R_o + R},$$

the diameter D of a section of a beam at the distance R will be:

$$D = D_o \cdot \left(1 + \frac{R}{R_o}\right)$$

and the density of a power flux p is:

$$\rho = \rho_o \cdot \frac{R_o^2}{(R_o + R)^2} = \frac{\rho_o}{(1 + m)^2},$$

$$m = \frac{R}{R_o}$$

where m is the attenuation of amplitude. At m>>1:

$$\rho = \frac{\rho_o}{m^2}$$

The density of power in the beam $\rho$ at m>>1 is attenuated in inverse proportion to the square of distance R, which is measured in quantities of Rayliegh distance $R_0$. The diffraction divergence of a beam is the major cause of the impairment of the signal. While some power is diverted into the transporting medium (water, air) as well, in practice it is significantly smaller than the impairment of the signal caused by the divergence of the beam. For example, the divergence of a beam of an antenna with $D_0$=100 $\lambda$ at the distance of 100 . . . 1000 km, is:

$$\left(\frac{R_o}{R}\right)^2 = 10^{-4} \ldots 10^{-6} = -40 \ldots -60\text{dB}$$

While at the same time, the losses from power diversion into atmosphere on such distances is as little as 3–4 dB.

Next, some restrictions on the theory of diffraction are noted. The diffraction formula of Fresnel-Kirchhoff includes the Green's (source) function and its derivative:

$$U = \frac{A \cdot e^{ikr}}{r}, \quad \frac{\partial U}{\partial n} = \frac{A \cdot e^{ikr}}{r} \cdot \left[ik - \frac{1}{r}\right]\cos(n, r) \tag{1.1}$$

where U is the field; A is the amplitude; k is the wave number; r is the distance; and n is the angle, from normal. This is consistent with the boundary conditions underlying the theories of a diffraction of Kirchhoff. In the case when the spectrum of a signal is varied over various emitters of a phased antenna array, the wave number k becomes a function of the coordinates of emitters. Then, the source function and its derivative also depend on the allocation of the wave numbers k under the aperture of radiation:

$$U = \frac{A \cdot e^{ikr}}{r}, \quad \frac{\partial U}{\partial n} = \frac{\partial U}{\partial k} \cdot \frac{dk}{dn} + \frac{\partial U}{\partial r} \cdot \frac{dr}{dn} \tag{1.2}$$

In the classical theory of a diffraction $$\frac{dk}{dn} = 0,$$

hence, $$\frac{\partial U}{\partial k} \cdot \frac{dk}{dn} = 0.$$

However, if k is not a constant, then $$\frac{dk}{dn} \neq 0.$$

Just such principle of the allocation of the wave number k on emitters in a phased antenna array is used in the present invention for compensation of diffraction. Thus, the principles of the present invention introduce a new function into the practical application of Green's (source) function, in which the derivative of a source function does not depend on distance r:

$$\frac{\partial U}{\partial k} \cdot \frac{dk}{dn} = \frac{A \cdot e^{ikr}}{r} \cdot [ir \cdot \cos(n, k)] = iAe^{ikr} \cdot \cos(n, k) \tag{1.3}$$

Next, the phase front of radiation of the phased antenna array is analyzed. A phase antenna array is considered with diameter $D_o$ much larger than the wavelength of the wave λ: $D_0 >> \lambda$. The radius of the curvature of the phase front $R_S$ in a plane of emitters of this phased antenna array at a monochromatic signal $e^{j(\omega)_0 t}$ is equal to infinity. However, even a short distance r from the plane of emitters, at distances $r \geqq \lambda$, because of the interference phenomena, the phase front radius of curvature $R_S$ will be definable.

The phase diagram of a phase antenna array, within the limits of a main beam an equal distance from center of a phased antenna array, a difference of phase detrusions between maximum direction of radiation (at the center of a beam) and minimum direction of radiation (on the periphery of a beam), equal π.

Figure 3:
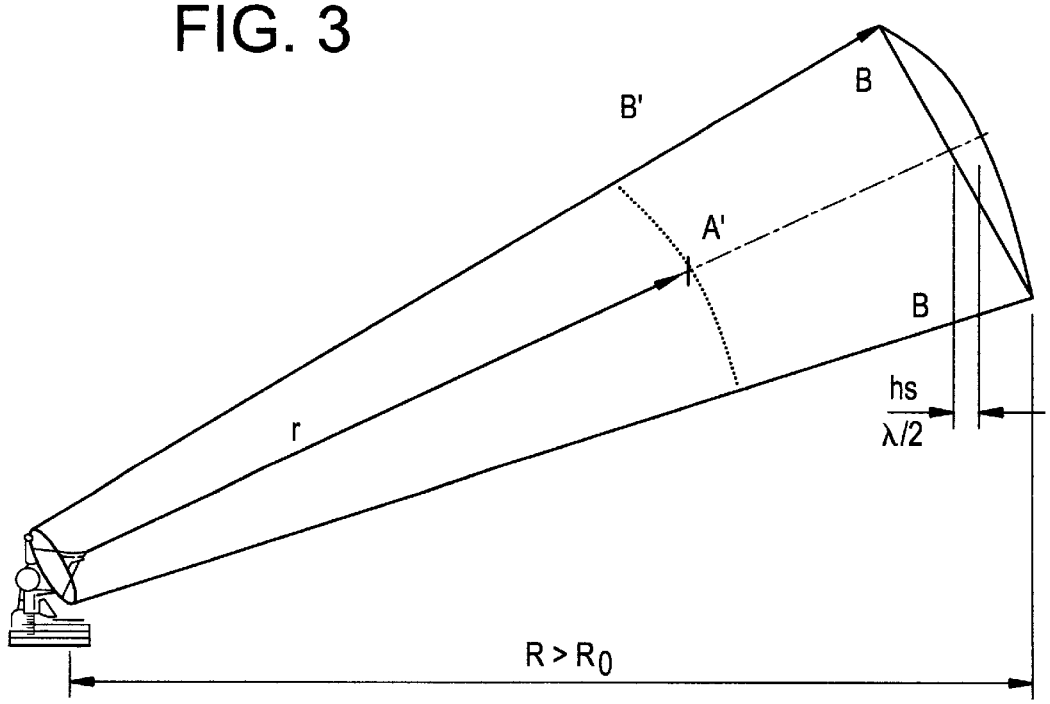
FIG. 3 is a schematic of an antenna propagating a wave.

Referring now to FIG. 3, the difference of phase trajectories between OA and OB, Δφ, on distances $R \geqq R_0$, approaches $$\frac{\lambda}{2} : \Delta\varphi = k_0 \cdot OA - k(\theta) \cdot OB = k_0 \cdot \frac{\lambda}{2} = \pi \tag{1.4}$$

-continued $$k_0 = \frac{2\pi}{\lambda}$$

where the wave number on the periphery of a beam is k(θ).

Since the diameter $D_0$ is much larger than the wavelength λ, $D_0 >> \lambda$, then the solid angle of the beam $$\Delta\theta_{00} = \frac{\lambda}{D} \ll 1.$$

In this case, a phase trajectory along a direction OA will be less then the phase trajectory along the direction OB. The difference between these trajectories, which equal $k_0$ (0A'–0B') will change with distance r in an interval $0 \leqq r \leqq R_0$ in the linear case:

$$\Delta\varphi(r) = \pi \frac{r}{R_o} \tag{1.5}$$

where Δφ(r) is the phase difference as a function of distance r. At the distance r, the height of a segment of phase front $h_s$, will be:

$$k_0 \cdot h_s = \pi \frac{r}{R_o}, \quad h_s = \frac{1}{2}\lambda \cdot \frac{r}{R_o} \tag{1.6}$$

The radius of curvature of phase front $R_S$ on the axis of a beam at the distance r depends on height of a segment h:

$$R_s = \frac{D^2}{8h_s}, \quad D = D_o\left(1 + \frac{r}{R_o}\right) \tag{1.7}$$

Applying the relationship for the diameter of a section of a beam at a distance R into the above, an expression for the radius of curvature of phase front in the far and near zones of the phase antenna array is derived:

$$R_s = \frac{D_o^2 \cdot \left(1 + \frac{r_s}{R_o}\right)^2}{8 \cdot \frac{1}{2} \cdot \lambda \cdot \frac{r}{R_o}} = \frac{1}{4} \cdot \frac{R_o}{r_s} \cdot \left(\frac{D_o}{\lambda}\right) \cdot \left(1 + \frac{r_s}{R_o}\right)^2 \tag{1.8}$$

At the distance r=λ, the radius of curvature will be:

$$R_s = \frac{1}{4} \cdot \left(\frac{D}{\lambda}\right)^2 \cdot R_o \tag{1.9}$$

On major distances $r = n \cdot R_0$, (n>>1), radius of curvature is:

$$R_s \cong \frac{n}{4} \cdot R_o \tag{1.10}$$

Thus, the non-divergent radiation of the phase antenna array at a monochromatic signal has phase front with curvature that depends on distance R. The radius of curvature of front $R_S$, close to the surface of the phase antenna array, r=λ, is several thousand times the Rayleigh distances, with the phase front practically flat. The radius of curvature again will become relatively flat on distances equal to several thousand Rayleigh distances. The maximum quantity of curvature of phase front takes place at Rayleigh distances, where $R_S = R_0$.

Next, the principles of the present invention which result in the compensation of diffraction are defined. All emitters (N) of the phase antenna array are grouped into Fresnel rings (interference bands) with an identical quantity of emitters. The diameter of a given ring $d_n$ is:

$$d_n = d_1 \cdot \sqrt{n} \qquad n = 1, 2, \ldots N \tag{1.11}$$

where the diameter of the first ring $d_1$ is:

$$d_1 = \frac{D_o}{\sqrt{N}}$$

At the equal amplitude allocation of a signal of the emitters of the phase antenna array, the power and the amplitudes of radiation of each ring will be identical.

The quantity of the Fresnel rings that can be formed on the phase antenna array is restricted by the fact that the width of a Fresnel ring cannot be less then the diameter of an emitter, $$\frac{1}{2}\lambda.$$

Then on the perimeter of phase antenna array, $\pi D_0$, is placed $$\frac{\pi \cdot D_o}{\frac{1}{2}\lambda} \approx 6\frac{D_o}{\lambda}$$

emitters. If the area of one emitter in a hexagonal phase antenna array is about 0.31 $\lambda^2$, then the surface area of one ring is:

$$S = 2 \cdot \pi \cdot \frac{D_o}{\lambda} \cdot 0.31\lambda^2 \approx 2D_o \cdot \lambda \tag{1.12}$$

The maximum quantity of Fresnel rings N which can be formed on phase antenna array will be defined by a relation:

$$N = \frac{\pi \cdot D_o^2}{4 \cdot S} \approx 0.4\frac{D_o}{\lambda} \tag{1.13}$$

Using the Fresnel rings, the principles of the present invention create a time lens. To create the time lens, signals with frequencies ω:

$$\omega_n = \omega_0 + n\Omega$$
$$n = 0,1,2, \ldots N \tag{1.14}$$
$$N \cdot \Omega << \omega_0$$

are applied on the emitters of the ring number n, where Ω defines the diffraction compensation spectrum and ΔΩ defines the spectrum of diffraction compensation. In an alternative embodiment of the invention signals with frequencies $\omega_n'$:

$$\omega_n' = \omega_0 - n\,\Omega$$

are applied on the emitters of the ring number n to create a dynamical positive lens. This allows, for example, wider coverage of a phased antenna array.

An equal initial phase of oscillations of signals of all frequencies is established at the moment of time t=0 in the surface of the phased antenna array (r=0).

$$\psi_n(0,0) = 0.$$

In the period of time Δt, the same phase allocation will be at the distance of:

$$r_t = c \cdot \Delta t, \; r_t << R_0,$$

i.e., $$\psi_n(0,0) = \psi_n(r_t, \Delta t).$$

After the same interval of time Δt, the oscillation phases on emitters will change and will become:

$$\psi_n(0,\Delta t) = \psi_n \cdot \Delta t = \omega_0 \cdot \Delta t + n \cdot \Omega \cdot \Delta t$$

The same allocation of phases will be at the distance r in an interval of time 2 Δt:

$$\psi_n(r,2\Delta t) = \psi_n(0,\Delta t) = \omega_0 \cdot \Delta t + n \cdot \Omega \cdot \Delta t = \phi_0 + n \cdot \Delta\phi$$
$$\phi_0 = \omega_0 \cdot \Delta t \tag{1.15}$$
$$\Delta\phi = \Omega \cdot \Delta t$$

Figure 4:
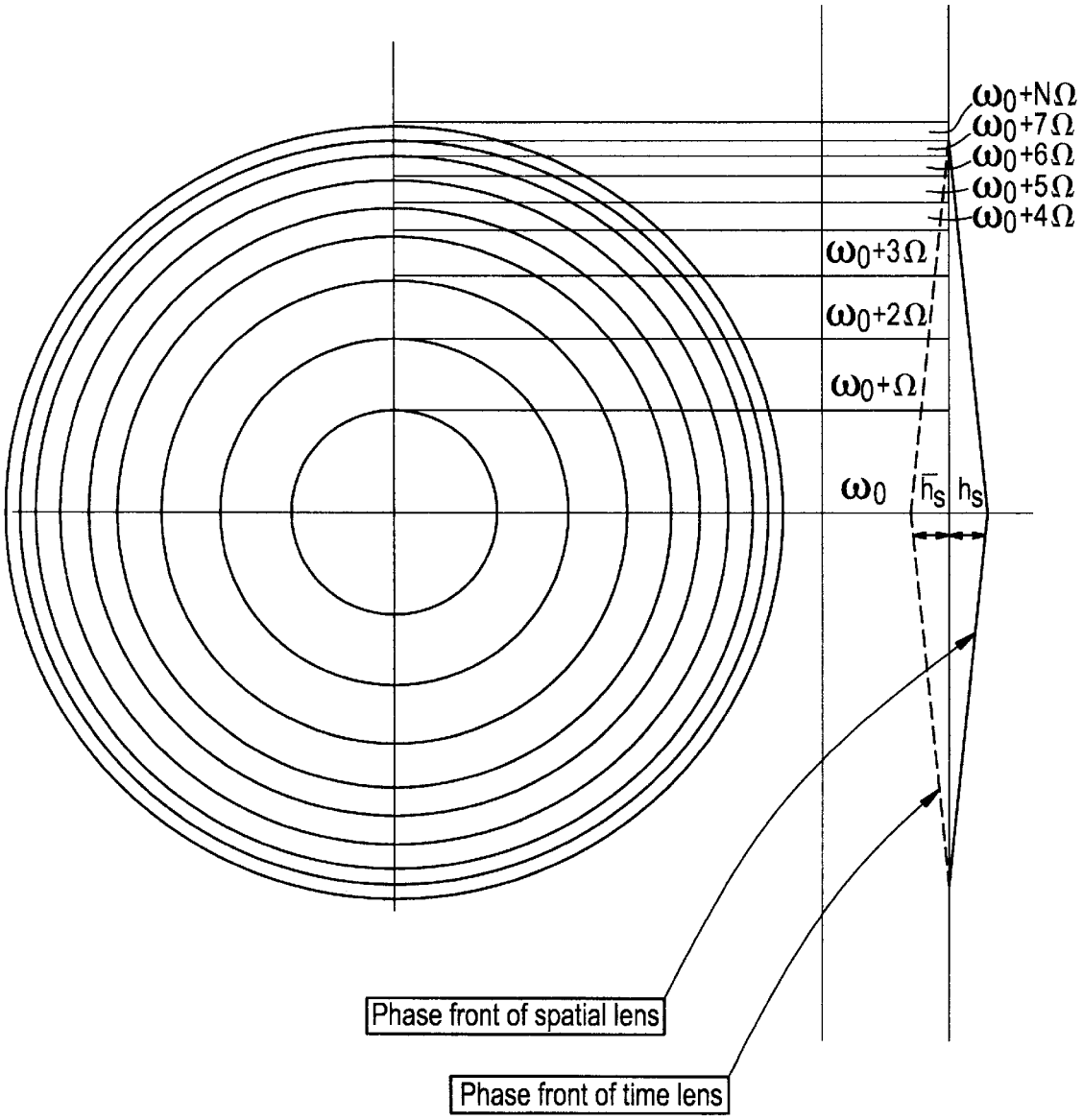
FIG. 4 is a schematic of the allocation of frequencies by emitters in accordance with the principles of the present invention.

The phase allocation consists of two parts: an additional constant component $\phi_0$ for all points of the aperture of the phase antenna array; and a varied by the aperture of the phase antenna array component n Δφ that becomes equal to zero at center and increases up to N Δφ on the periphery of aperture. Such allocation of phases in a near zone will form a time lens. This time lens will form a constantly concurrent phase front of radiation. Thus, the time lens acts as a dynamic positive lens. The time lens is shaped by a time spectrum of a signal in the near zone of the phase antenna array. Allocation of frequencies by emitters and the relevant section of phase front of a lens is shown on FIG. 4.

The radius of curvature of time phase front is determined at the distance r, from the surface of the phase antenna array. Similarly, the relation (1.6) defines the segment h of the time phase front:

$$k_0 \cdot h_t = \Delta k_{max} \cdot r_t,$$

where $$\Delta k_{\max} = \frac{\omega_{\max}}{c} - \frac{\omega_o}{c} = \frac{N \cdot \Omega}{c} = \frac{\Omega_{\max}}{c} = \frac{\omega_o \cdot \Omega_{\max}}{c \cdot \omega_o} = ko \cdot \frac{\Omega_{\max}}{\omega_o} \tag{1.16}$$
$$h_t = r_t \cdot \frac{\Omega_{\max}}{\omega_o}$$

then the radius of curvature $R_t$ is:

$$R_t = \frac{D_o^2}{8 \cdot h_t} = \frac{1}{8} \cdot \frac{R_o}{r_t} \cdot \lambda_o \cdot \frac{\omega_o}{\Omega_{\max}} \tag{1.17}$$

Next, the compensation of the spatial spectrum by time spectrum is explored. Two processes of an interference of time signals on distances $r << R_0$ from the surface of the phase antenna array have been considered: an interference of monochromatic radiation; and an interference of non-monochromatic radiation—time spectrum, distributed on the Fresnel rings. For monochromatic and non-monochromatic radiation, the height of segments and the radiuses of curvature of phase fronts are determined by relation (1.6), (1.16) and (1.8), (1.17):

$$h_s = -\frac{1}{2} \cdot r_s \cdot \frac{\lambda}{R_o} \qquad h_t = r_s \cdot \frac{\Omega_{\max}}{\omega_o} \tag{1.18}$$
$$R_s = -\frac{1}{4} \cdot \frac{R_o}{r_s} \cdot \lambda_o \cdot \left(\frac{D_o}{\lambda_o}\right)^2 \qquad R_t = \frac{1}{8} \cdot \frac{R}{r_t} \cdot \lambda_o \cdot \frac{\omega_o}{\Omega_{\max}}$$

The radius of curvature of a composite field $R_\Sigma$ that is created by the spatial and time lenses of the present invention, is determined by the formula of addition of focal distances of lenses:

$$\frac{1}{R_\Sigma} = \frac{1}{R_s} + \frac{1}{R_t} \tag{1.19}$$

Using relation (1.8):

$$R_\Sigma = R_o \cdot \lambda_o \cdot \frac{1}{r_s \cdot \left(\frac{\lambda_o}{D_o}\right)^2 - r_t \cdot 2 \cdot \frac{\Omega_{\max}}{\omega_o}} \tag{1.20}$$

It follows that, the relative value of frequencies of a time spectrum $$\frac{\Omega_{\max}}{\omega_o}$$

is interdependent to a relative dimension of the phase antenna array $$\left(\frac{D_o}{\lambda_o}\right)^2$$

by equation:

$$2 \cdot \frac{\Omega_{\max}}{\omega_o} \cdot \left(\frac{D_o}{\lambda_o}\right)^2 \cdot \frac{r_t}{r_s} = 1, \tag{1.21}$$

then $R_\Sigma \to \infty$

The phenomena of compensation of diffraction by the time spectrum is achieved under this condition. At the same time, the compensation of time spectrum by the diffraction will take place under interdependent compensation of spatial and time spectrums.

This phenomenon can occur under following conditions: at concurrent phase front of a time lens and phase front of a diffraction in same volume of a beam:

$$r_t = r_s$$

and at carried from each other lens (as is implemented in optics):

$$r_t > r_s,\ r_t < r_s$$

Through the principles of the present invention, a new phase front is provided that has the same absolute value and dynamics of change of curvature as the phase front at the diffraction, but at opposite directions. The combination of the new phase front and the phase front at the diffraction creates a continuous concurrence of a beam, i.e., an interference is produced, which is opposite to the diffraction. Since these processes occur at the same time in the same value of a beam of the phased antenna array, diffraction compensation occurs.

If the frequency spectrum $\Delta\omega < \Omega_{max}$, then partial compensation of diffraction occurs. If the frequency spectrum $\Delta\omega >_{max}$, then over compensation of diffraction occurs and the spatial-time focusing of a beam will take place. If the frequency spectrum $\Delta\omega < 0$, then the beam width will increase.

The relationships defined by equations (1.8) and (1.9) determine the requirements of complete compensation of the diffraction divergence of a beam. In practice, the compensation of a diffraction is limited because of the discrete character of allocation of emitters in the antenna system, heterogeneousness of amplitude and phased allocation of a radiated field, technological tolerances, and other factors. In the following example, the parameters required to achieve 90% compensation of a diffraction are defined using the basic parameters of a phased antenna array (Rayleigh distance, attenuation of a signal from the diffraction, effective diameter of the antenna, coefficient of a directional effect, angular divergence of the beam):

EXAMPLE

Rayleigh Distance

Under the principles of the present invention, the Rayleigh Distance is equal to radius of curvature of the phase front and is defined by relation (1.20). Under condition of maximum value of a spectrum $r_s = r_t = \Delta_0$:

$$R_\Sigma = R_o \cdot \left(\frac{D_o}{\lambda_o}\right)^2 \cdot \frac{1}{1 - y_o}, \tag{1.22}$$

where $$y_o = \frac{r_t}{r_s} \cdot 2 \cdot \frac{\Omega_{\max}}{\omega_o} \cdot \left(\frac{D_o}{\lambda_o}\right)^2$$

At 100% compensation $\gamma_0 = 1$. At 90% compensation, the minimum value $\gamma_0 = 1 \pm 0.1$. Then relation (1.22) is conversed to:

$$R_\Sigma \geq 10 \cdot R_o \cdot \left(\frac{D_o}{\lambda_o}\right)^2 = 10 \cdot \left(\frac{D_o}{\lambda_o}\right)^4 \cdot \lambda_o \tag{1.23}$$

It follows that Rayleigh distance under the principles of the present invention has increased $$10 \cdot \left(\frac{D_o}{\lambda_o}\right)^2$$

times. For example, for a phased antenna array with $D_0 = (20 \ldots 100)\ \Delta_0$, $\Delta_0 = 0.03$m, $R_0 = 12 \ldots 300$m, $R_\Sigma = 48 \ldots 30{,}000$ km. Thus, under the principles of its present invention, the Rayleigh distance has increased considerably.

Attenuation of a Signal from the Diffraction

The attenuation of density of power flux $M_0$ with distance is in inverse proportion to the square of this distance:

$$M_o = \left(\frac{R_o}{R}\right)^2$$

Under the principles of the present invention, the Rayleigh distance has increased up to $R_\Sigma$, then the impairment of a signal will be equal:

$$M = \left(\frac{R_\Sigma}{R}\right)^2$$

The relation $$\frac{M}{M_o}$$

determines a scoring in a mode of compensation of the diffraction:

$$\frac{M}{M_o} = \left(\frac{R_\Sigma}{R_o}\right)^2 \tag{1.24}$$

Using relation (1.24), $$\frac{M}{M_o} = 100 \cdot \left(\frac{D_o}{\lambda_o}\right)^2 \tag{1.25}$$

For example, for a phase antenna array with $$D_o = (20 \ldots 100)\lambda_o,$$
$$\lambda_o = 0.03\,\text{m},$$
$$\frac{M}{M_o} = 100 \cdot (1.6 \cdot 10^5 \ldots 10^8) = 1.6 \cdot 10^7 \ldots 10^{10} \text{or} 70 \ldots 100\,\text{dB}.$$

Thus, under the principles of the present invention, a considerable increase in the range of the antenna, or a reduction of the size and power required, occurs.

Effective Diameter of the Antenna

The effective diameter of the antenna $D_{eff}$ under the principles of the present invention is defined from relation (1.23):

$$D_{eff} = D_o \cdot \sqrt{10} \cdot \frac{D_o}{\lambda_o} \tag{1.26}$$

Thus, the effective diameter of the antenna $D_{eff}$ exceeds its geometrical size by more than in $$\left(\frac{D_0}{\lambda_0}\right).$$

Thus, the effective diameter of the antenna $D_{eff}$ under the principles of the present invention is equal to a diameter of the antenna at which divergence is the same as at the antenna with a diameter $D_0$.

Coefficient of a Directional Effect

The coefficient of a directional effect $KDA_{KD}$ under the principles of the present invention is defined as the relation of the effective surface area of the antenna $S_{eff}$ and the spatial angle $$\frac{\lambda_0^2}{4\pi} : KDA_{KD} = \frac{4 \cdot \pi \cdot S_{eff}}{\lambda_0^2} = KDA_0 10 \cdot \left(\frac{D_0}{\lambda_0}\right)^2 \tag{1.27}$$

where $KDA_0$ is the coefficient of a directional effect without diffraction compensation. Thus, under the principles of the present invention, the coefficient of directional effect is increased $$\frac{10\pi}{4} \cdot \left(\frac{D_0}{\lambda_0}\right)^2$$

times.

Angular divergence of the beam

Under the principles of the present invention, the angular divergence of the beam $\theta_{0\ KD}$ is defined by a relation:

$$\theta_{0KD} = \frac{\lambda_0}{D_{eff}} = \frac{\lambda_0}{D_0} \cdot \frac{1}{\sqrt{10}} \cdot \frac{\lambda_0}{D_0} = \theta_0 \cdot \frac{1}{\sqrt{10}} \cdot \frac{\lambda_0}{D_0} \tag{1.28}$$

Thus, the angular divergence of a beam under the principles of the present invention decreases more than $$\left(\frac{D_0}{\lambda_0}\right)$$

times.

Hardware of the Present Invention

The hardware utilized in practicing the method of the present invention contains two basic parts: an antenna and a multi-channel generator. In practicing the present invention, traditional controllable phase shifters are not used, but rather the guidance of the phases of a signal is determined in the channels of the multi-channel generator.

In a preferred embodiment of the present invention, the emitters, being at identical distance $r_m$ from the center of the phased antenna array, are grouped in modular (m). On each module, the component of a spectrum is applied, the frequency of which is directly proportional to value $r_m$:

$$\Omega_m = 2 \cdot \Omega_{\max} \cdot \frac{r_m}{D_0}$$

where $\Omega_{max}$ is defined by relation (1.21); and $D_0$ is the diameter of the phased antenna array.

Figure 5:
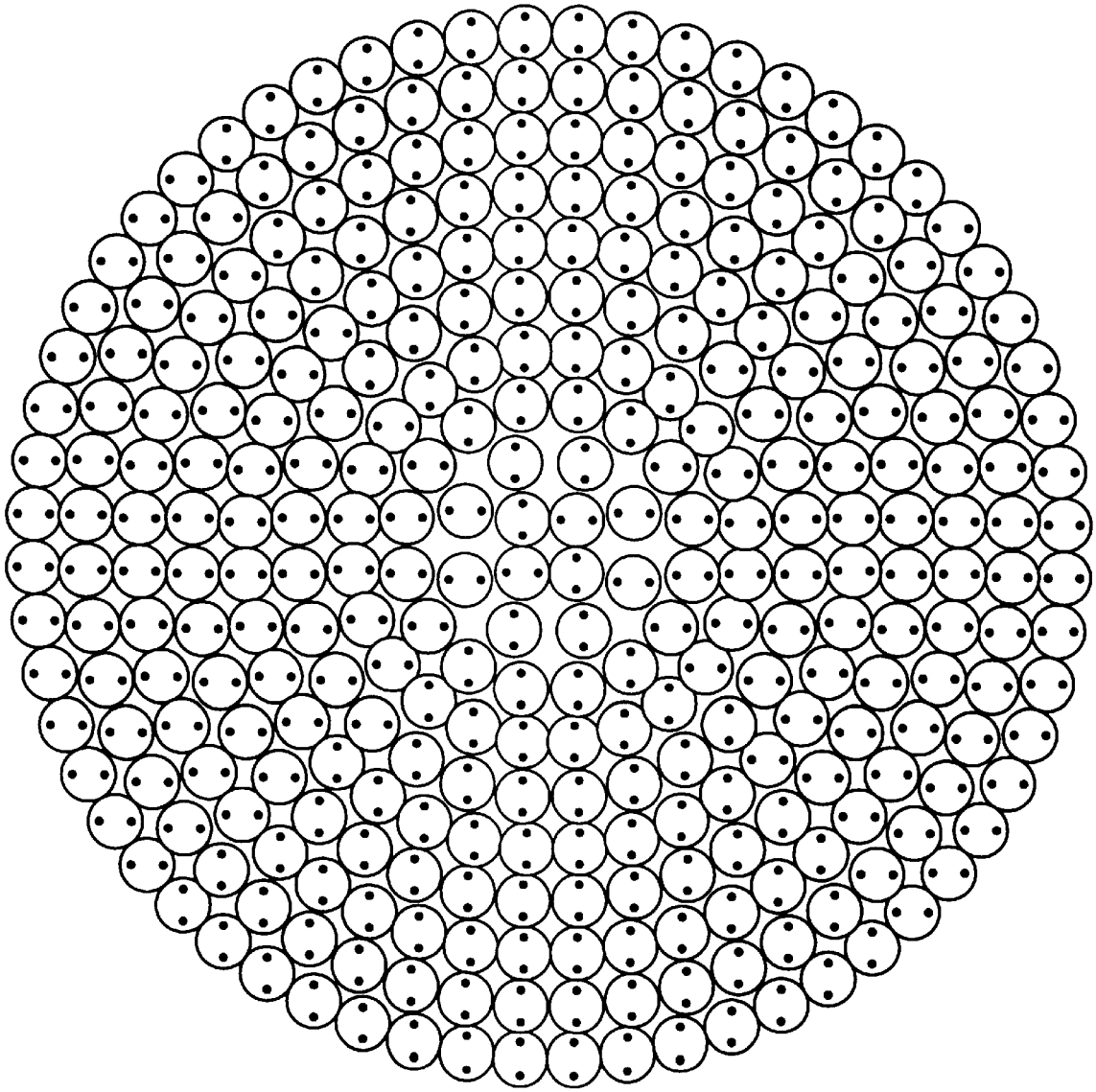
FIG. 5 is a preferred embodiment of a configuration of a phased antenna array made in accordance with the principles of the present invention.

The principles of the present invention are applicable to any configuration of a phases antenna array (e.g. hexagonal, rectangular). It has been determined that a phased antenna array of the round shape with allocation of emitters in modules on concentric circles is the preferred embodiment of the present method. Referring to FIG. 5, a preferred embodiment of the configuration of the phased antenna array with the allocation of emitters in modules on concentric circles is seen. The typical allocation of frequencies on modules at partial, complete compensation and overcompensation is shown on table 2.1.

| Ring Number | 1 | 2 | 3 | 4 | 5 | 6 | 7 | 8 | 9 | 10 |
|---|---|---|---|---|---|---|---|---|---|---|
| Frequency Hz | 0 | 3.1 | 6.2 | 9.3 | 12.4 | 15.5 | 18.6 | 21.7 | 24.8 | 27.9 |

A multi-channel generator of a given number (N) of frequencies creates a given number of independent voltages (N) for driving of emitters. The diagram of the multi-channel generator is shown on FIG. 6.

The basic requirement for the multi-channel generator in the mode of diffraction compensation is a long-term stability of given value of a difference of frequencies in all channels and constancy of phase front of a time spectrum. Known digital technology allows a solution to this problem by periodic return of numeral counters to a "zero" in the initial phase of oscillations.

Figure 6:
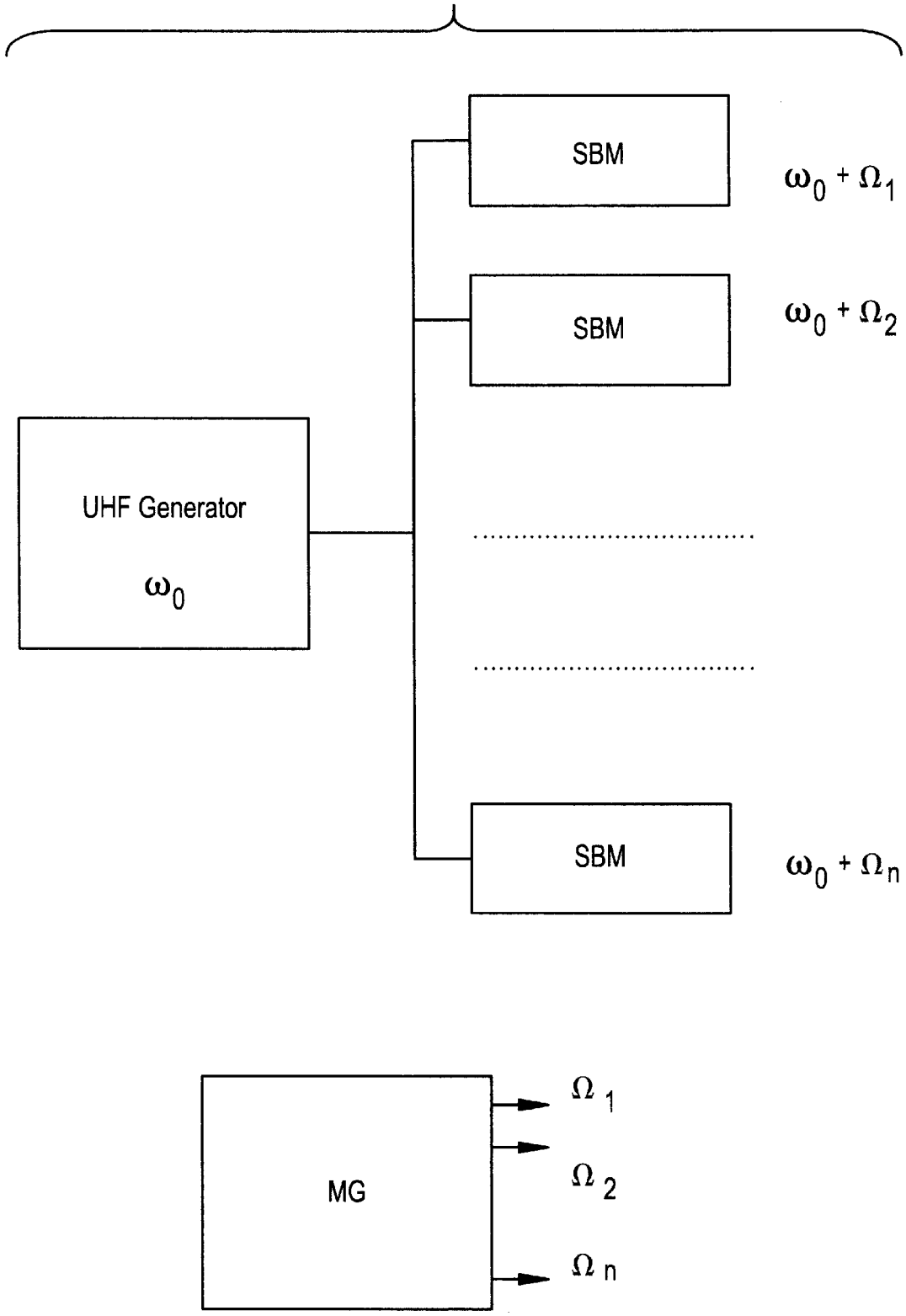
FIG. 6 is a schematic diagram of a multi-channel generator.

The phased antenna array and multi-channel generator for diffraction compensation in an ultrasonic band is a physical analog of UHF prototype. The multi-channel generator, working in a ultrasonic band, is able to generate up to 10 . . . 20 MHz. For example, for compensation of diffraction of a phased antenna array with the dimensions of 100 λ, on frequency 10 GHz require a frequency bandwidth of about 0.5 MHz. Therefore, the typical configuration of multi-channel generator in UHF can be constructed with shifting of a spectrum multi-channel of a ultrasonic band in UHF a band by the system with N modulators of UHF, as shown in FIG. 6.

EXPERIMENTAL DATA

The method of the present invention were implemented in an ultrasonic gamut, including a phased antenna array containing 319 emitters on 25 kHz and a 10-channel generator, creating a spectrum from 10 harmonic builder. In a mode of monochromatic radiation of the phased antenna array, the level of the first side lobe was −13 . . . −16 dB. The beam width on a −3 dB level was 2.9° . . . 3.2°.

In a mode of compensation of diffraction, the level of the first lateral lobe was reduced up to −30 . . . −36 dB. Thus, the level of dispersion because of diffraction was reduced on 16 . . . 20 dB. Accordingly, the beam width at level −3 dB was 2.2° . . . 2.5°.

The basic restrictions of a degree of compensation are bound to a degree of flatness of a radiated wavefront, with the quality of the tuning of the phased antenna array. With a change of flatness from ±30° . . . ±10°, the degree of compensation increased 10 dB. Tuning the phased antenna array to a flatness of up to about one degree or less is technically feasible. Thus, the level of a dispersion because of a diffraction will be about −40 . . . −50 dB.

It should be understood that various changes and modifications to the preferred embodiment of the present invention described herein will be apparent to those skilled in the art. Such changes and modifications can be made without departing from the spirit and scope of the present invention and without diminishing its attendant advantages. It is therefore intended that such changes and modifications be covered by the appended claims.

What is claimed is:

1. A method for the transmission of wave energy, by an antenna system having a plurality of emitters, to compensate for diffraction divergence of the wave energy comprising the steps of:

distributing frequencies among the plurality of emitters such that a freguency for a given emitter is proportional to the distance of that given emitter from a center of the antenna system; and propagating the wave energy generated by said plurality of emitters.

2. The method of claim 1, wherein the value of the frequency for a given emitter is in linear proportion to the distance of the emitter from the center of the antenna system.

3. The method of claim 1, wherein the value of the frequency for a given emitter is in square proportion to the distance of the emitter from the center of the antenna system.

4. A method for the propagation of wave energy from an antenna system having a plurality of radiation emitters, comprising the step of:

distributing, on said radiation emitters, frequencies, the value of the frequency for a given emitter being proportional to the distance of the emitter from a center of the antenna system whereby wave energy is propagated.

5. The method of claim 4, wherein said frequencies are distributed such that a new phase front is provided.

6. The method of claim 5, wherein the new phase front is created by the summing a phase front formed by the time spectrum and a phase front created by diffraction divergence compensation thereby creating a new phase front.

7. The method of claim 6, wherein the summing of the phase front formed by a radius of the phase front of the time spectrum is opposite to and has the same value as a radius of the phase front created by diffraction divergence compensation.

8. The method of claim 6, wherein the summing of the phase front formed by a radius of the phase front of the time spectrum is opposite to and has a greater value than a radius of the phase front created by diffraction divergence compensation, such that the divergence of the wave energy is reduced.

9. The method of claim 6, wherein the summing of the phase front formed by a radius of the phase front of the time spectrum is collinear to a radius of the phase front created by diffraction divergence compensation, such that the divergence of the wave energy is increased.

10. A phased antenna array comprising:

a plurality of emitters;

a multi-channel generator; and means for distributing frequencies generated by the multi-channel generator to the emitters.

11. The phased antenna array of claim 10, wherein the means for distributing frequencies generated by the multi-channel generator to the emitters creates a new phase front.

12. The phased antenna array of claim 10, wherein the emitters are grouped into Fresnel rings, with the frequency applied to emitters in a Fresnel ring being about equal.

13. The phased antenna array of claim 10, wherein signals with frequencies ω:

$$\omega_n=\omega_0+n\Omega$$

are applied to the emitters of a Fresnel ring (n), where Q defines the diffraction compensation spectrum.

14. The phased antenna array of claim 10, wherein signals with frequencies ω:

$$\omega_n=\omega_0-n\Omega$$

are applied to the emitters of a Fresnel ring (n), where Ω defines the diffraction compensation spectrum.

15. The phased antenna array of claim 10, wherein the emitters are allocated in modules on concentric circles.

16. The phased antenna array of claim 10, wherein new phase front is created by distributing frequencies such that the value of the frequency for a given emitter is proportional to the distance of the emitter from the center of the antenna system.

17. The phased antenna array of claim 16, wherein a radius of the new phase front has about the same value and dynamics of change of curvature as a radius of the phase front of diffraction, but at opposite directions.

18. The phased antenna array of claim 16, wherein a radius of the new phase front radius has a greater value and dynamics of change of curvature as a radius of the phase front of diffraction, but at opposite directions.

19. The phased antenna array of claim 16, wherein a radius of the new phase front has a less value and dynamics of change of curvature as a radius of the phase front radius of diffraction, but at opposite directions.

20. A phased antenna array comprising:

a plurality of emitters;

a multi-channel generator; and means for distributing frequencies generated by the multi-channel generator to the emitters, wherein signals with frequencies ω:

$$\omega_n=\omega_0+n\Omega$$

are applied to the emitters of a Fresnel ring (n), where Ω defines the diffraction compensation spectrum.

21. The phased antenna array of claim 20, wherein the means for distributing frequencies generated by the multi-channel generator to the emitters creates a new phase front.

22. The phased antenna array of claim 20, wherein the emitters are allocated in modules on concentric circles.

23. The phased antenna array of claim 20, wherein a new phase front is created by distributing frequencies such that the value of the frequency for a given emitter is proportional to the distance of the emitter from the center of the antenna system.

24. The phased antenna array of claim 23, wherein a radius of the new phase front has about the same value and dynamics of change of curvature as a radius of the phase front of diffraction, but at opposite directions.

25. The phased antenna array of claim 23, wherein a radius of the new phase front radius has a greater value and dynamics of change of curvature as a radius of the phase front of diffraction, but at opposite directions.

26. The phased antenna array of claim 23, wherein a radius of the new phase front has a less value and dynamics of change of curvature as a radius of the phase front radius of diffraction, but at opposite directions.

27. The phased antenna array of claim 20, wherein each of said frequencies are in phase at a time t=0.

28. The phased antenna array of claim 20, wherein said frequencies form a time lens.

29. The phased antenna array of claim 20, wherein the value of the frequency for a given emitter is in linear proportional to the distance of the emitter from the center of the antenna system.

30. The phased antenna array of claim 20, wherein the value of the frequency for a given emitter is in square proportional to the distance of the emitter from the center of the antenna system.

31. A phased antenna array comprising:

a plurality of emitters;

a muti-channel generator; and means for distributing frequencies generated by the multi-channel generator to the emitters, wherein signals with frequencies ω:

$$\omega_n=\omega_0-n\Omega$$

are applied to the emitters of a Fresnel ring (n), where Ω defines the diffraction compensation spectrum.

32. The phased antenna array of claim 31, wherein the means for distributing frequencies generated by the multi-channel generator to the emitters creates a new phase front.

33. The phased antenna array of claim 31, wherein the emitters are allocated in modules on concentric circles.

34. The phased antenna array of claim 31, wherein a new phase front is created by distributing frequencies such that the value of the frequency for a given emitter is proportional to the distance of the emitter from the center of the antenna system.

35. The phased antenna array of claim 34, wherein a radius of the new phase front has about the same value and dynamics of change of curvature as a radius of the phase front of diffraction, but at opposite directions.

36. The phased antenna array of claim 34, wherein a radius of the new phase front radius has a greater value and dynamics of change of curvature as a radius of the phase front of diffraction, but at opposite directions.

37. The phased antenna array of claim 34, wherein a radius of the new phase front has a less value and dynamics of change of curvature as a radius of the phase front radius of diffraction, but at opposite directions.

38. The phased antenna array of claim 31, wherein each of said frequencies are in phase at a time t=0.

39. The phased antenna array of claim 31, wherein said frequencies form a time lens.

40. The phased antenna array of claim 31, wherein the value of the frequency for a given emitter is in linear proportional to the distance of the emitter from the center of the antenna system.

41. The phased antenna array of claim 31, wherein the value of the frequency for a given emitter is in square proportional to the distance of the emitter from the center of the antenna system.

42. A phased antenna array comprising:

a plurality of emitters arranged in a plurality of groups (n); and means for distributing frequencies to the emitters, wherein signals with frequencies $\omega_n=\omega_0+n\Omega$ are applied to the emitters of each of said plurality of groups (n).

43. The phased antenna array of claim 42 wherein said means for distributing frequencies includes a multi-channel generator.

44. The phased antenna array of claim 42 wherein Ω defines the diffraction compensation spectrum.

45. The phased antenna array of claim 42 wherein each of said plurality of groups (n) comprises a Fresnel ring.

46. The phased antenna array of claim 45 wherein each of said plurality of groups (n) comprises an identical number of emitters.

47. The phased antenna array of claim 46 wherein each of said Fresnel rings of a group (n) has a diameter:

$$d_n = \frac{D_0}{\sqrt{N}}\sqrt{n}$$

where $D_0$ is a diameter of the phased antenna array, and N is the number of said plurality of groups (n).

48. The phased antenna array of claim 45 wherein each of said plurality of Fresnel rings are concentric.

49. The phased antenna array of claim 42 wherein each of said signals applied to the emitters have approximately the same amplitude.

50. The phased antenna array of claim 42 wherein each of said signals applied to the emitters have the same phase at a time 0.

51. The phased antenna array of claim 42 wherein $\omega_0$ is 25 kHz.

52. The phased antenna array of claim 42 wherein the number of said plurality of groups (n) is 10.

53. A method of radiating energy from an antenna system having a center point and a plurality of emitters arranged about said center point comprising the steps of:

generating a plurality of signals to be applied to a corresponding one of said plurality of emitters, each of said signals having a frequency proportional to a distance of said corresponding one of said plurality of emitters from said center point; and applying said plurality of signals to said corresponding one of said plurality of emitters to radiate energy.

54. The method of claim 53 wherein said antenna system is a phased antenna array.

55. The method of claim 53 wherein said plurality of emitters are arranged in concentric circles about said center point of the antenna system.

56. The method of claim 55 wherein each emitter in each of said concentric circles is spaced approximately the same distance from said center point and receives a signal having approximately the same frequency.

57. The method of claim 55 wherein each of said concentric circles comprise a Fresnel ring.

58. The method of claim 57 wherein said antenna system comprises N concentric circles of emitters designated 1, 2, 3 . . . n, and said plurality of signals have a corresponding frequency $\omega_n$ defined by $\omega_n=\omega_0+n\Omega$, where $\omega_0$ is a fixed offset frequency and Ω is a frequency difference.

59. The method of claim 58 wherein said fixed offset frequency $\Omega_0$ is 25 kHz and said frequency difference Ω is 3.1 Hz.

60. A method for the transmission of wave energy, by an antenna system having a central emitter and a plurality of peripheral emitters, to compensate for diffraction divergence of the wave energy comprising the steps of:

applying a first frequency to the central emitter;

distributing frequencies among the plurality of peripheral emitters adjacent to the central emitter such that a difference between a frequency for a given peripheral emitter and said first frequency is proportional to the distance of that given peripheral emitter from the central emitter; and propagating the wave energy generated by the central emitter and the plurality of peripheral emitters.

61. The method of claim 60, wherein the difference in frequency for a given peripheral emitter is in linear proportion to the distance of the peripheral emitter from the central emitter.

62. The method of claim 1, wherein the difference in frequency for a given peripheral emitter is in square proportion to the distance of the peripheral emitter from the central emitter.

* * * * *